US006541403B2

(12) United States Patent
Billarant et al.

(10) Patent No.: US 6,541,403 B2
(45) Date of Patent: Apr. 1, 2003

(54) ELASTIC CORE FIBRE AND AN ELASTIC NONWOVEN

(75) Inventors: Jean-Philippe Billarant, Paris (FR); Donald H. Lester, Waxhaw, NC (US)

(73) Assignee: Aplix, Paris (FR)

( * ) Notice: Subject to any disclaimer, the term of this patent is extended or adjusted under 35 U.S.C. 154(b) by 128 days.

(21) Appl. No.: 09/725,529

(22) Filed: Nov. 29, 2000

(65) Prior Publication Data

US 2001/0038912 A1 Nov. 8, 2001

(30) Foreign Application Priority Data

Nov. 29, 1999 (FR) ..... 99 15009

(51) Int. Cl.[7] ..... B32B 5/02; D04H 3/00; D02G 3/22; D02G 3/32

(52) U.S. Cl. ..... 442/364; 442/361; 442/328; 442/329; 428/373; 428/376; 428/397; 428/399; 428/400

(58) Field of Search ..... 428/373, 377, 428/378, 397, 399, 400, 376; 57/20–235; 442/361, 362, 363, 364, 328, 329

(56) References Cited

U.S. PATENT DOCUMENTS 3,657,873 A * 4/1972 Gibson et al. ..... 57/152
3,763,640 A * 10/1973 Nagel et al. ..... 57/34
3,921,382 A * 11/1975 Tsujita et al. ..... 57/157
4,150,529 A * 4/1979 Northup ..... 57/6
4,467,595 A * 8/1984 Kramers ..... 57/225
5,069,957 A * 12/1991 Vandermeersch ..... 428/230
5,560,192 A * 10/1996 Frith ..... 57/226
6,225,243 B1 * 5/2001 Austin ..... 442/361
6,174,601 B1 * 6/2001 Stanitis et al. ..... 428/373

FOREIGN PATENT DOCUMENTS

| | | |
|---|---|---|
| JP | 09 291420 A | 11/1997 |
| WO | WO 94 25648 A | 11/1994 |
| WO | WO 00 08243 A | 2/2000 |

* cited by examiner

*Primary Examiner*—Cheryl A. Juska
*Assistant Examiner*—Lynda Salvatore
(74) *Attorney, Agent, or Firm*—Adams, Schwartz & Evans, P.A.

(57) ABSTRACT

A bicomponent elastic fiber that includes a core formed of an elastic fiber and having a sheath formed of a non-elastic material surrounding the core. The sheath has at least one cut therein extending at an angle to the length of the fiber to expose and release the elasticity of the core elastic fiber. This provides elasticity to the bicomponent elastic fiber.

8 Claims, No Drawings

ELASTIC CORE FIBRE AND AN ELASTIC NONWOVEN

This application claims priority of French Patent Application No. 99 15009 filed Nov. 29, 1999.

TECHNICAL FIELD AND BACKGROUND OF THE INVENTION

The invention relates to elastic fibres and nonwovens for use in articles such as nappies, or baby diapers, sanitary towels, tampons or incontinence pads, bandages or in general for other similar articles used for hygienic purposes.

In numerous applications, nonwovens need some elasticity. In nappies, the fabric must stretch and contract in dependence on the normal movements of the child. A nappy without these elastic characteristics will restrict movement or leak. The elastic material should also be soft, easy to handle, and capable of breathing.

Elastomers used for elastic films often have an undesirable rubbery feel. When the substances are used in composite nonwovens, the user in contact with the fabric has a rubbery or sticky feeling which is undesirable for direct contact with the skin.

Elastic fabrics usually comprise elastic nonwovens or layers of elastic film. When elastic films are used and the fabric needs to breathe, it is conventional to make holes in the films. These holes may weaken the film and, when stretched, may constitute a site from where tears propagate in the film. Thin films are desirable economically but have limited strength, and this limitation is complicated by the presence of holes.

One method to meet the need for elasticity and for good contact with the skin, is to place a layer of fibrous nonwoven fabric on the elastic layer, producing a composite fabric having improved properties. The nonwoven fabric gives a surface covering the elstomeric layer and soft, capable of breathing and suitable for direct contact with the skin. The nonwoven layer also gives additional strength to composite materials. Solutions of this kind are described in U.S. Pat. Nos. 5,921,973, 5,853,881, 5,709,921, 5,681,645, 5,413,849 and 5,334,446.

The composite fabric has to be made in a number of operations with expensive equipment and raw material, including the elastic substances, nonwovens and adhesives.

WO 9425648 describes fibres having two constituents such as a core and sheath. The two constituents are preferably elastic.

SUMMARY OF THE INVENTION

The invention is concerned with fibres for obtaining a nonwoven without the need to produce a composite product or the resulting costs of operation and adhesives, while having the softness and feel required for contact with the skin and the elasticity required for the previously-mentioned hygienic articles.

DESCRIPTION OF THE PREFERRED EMBODIMENT AND BEST MODE

The invention relates to a fibre having a core surrounded by a non-elastic sheath. According to the invention, the core is elastic and the sheath is broken along the side. "Elastic" means that the core stretches by at least 125%, preferably at least 150% of its length in the non-stretched state.

The core gives the required elasticity to the fibre and consequently to the nonwoven making up at least part of the said fibres, whereas the sheath, which is non-elastic, can be of a material suitable for bringing into contact with the skin.

Preferably the sheath is broken at a number of places, preferably at a distance from one another, preferably at regular distances from one another.

Preferably the core, after being stretched to 150% and after the stretching force has been relaxed, loses at least 25% and preferably at least 50% of its elongation, A material which does not meet these criteria is considered non-elastic in the present specification.

Good results have been obtained when the fibres according to the invention have a denier of 2 to 25 and when the sheath makes up 30 to 70% of the weight of the fibre and in complementary manner when the core makes up to 70 to 30% thereof.

The core can be made of materials such as sequenced copolymers, e.g. poly(ethylene-butene), poly(ethylene-hexene) poly(ethylene-propylene) poly(ethylene-octene), poly(styrene-butadiene-styrene), poly(styrene-ethylene and butylene-styrene), poly(styrene-isoprene-styrene), a poly (ester ether oxide), a poly(ether oxide-amide), poly (ethylene-vinyl acetate), poly(ethylene-methylacrylate), poly(ethylene-acrylic acid), poly(ethylene-butyl acrylate) or mixtures thereof or tetra-sequenced copolymers such as described in U.S. Pat. No. 5,332,613, e.g. a (polyethylene-propylene)-styrene-poly(ethylene-propylene)styrene.

Also, use can be made of a novel class of rubber-like polymers described as polyolefins produced with a catalyst at a single site. The most preferred catalysts are known in the art as metallocene catalysts capable of polymerising ethylene, propylene, styrene or other olefins with butene, hexene, octene, etc., to obtain elastomers suitable as materials for forming the core of a fibre according to the invention. The substances for forming the sheath are chosen in dependence on cost, the possibility of extrusion, compatibility with the core materials, resistance to tearing and elongation, and the desired surface properties for obtaining good contact with the skin. Examples are polyethylene, polypropylene, a polyester, a polyamide or mixtures thereof.

Preference is given to low-density polyethylene and polypropylene having fluidity indices between 0.1 and 105 g/10 mm approx. (ASTM D 1238-8 9 190° C.).

The core and the sheath can be concentric, or alternatively the core can be eccentric in the sheath or can be of the island kind, the islands being distributed symmetrically or otherwise in the sheath matrix. One preferred method of making a fibre according to the invention is described in U.S. Pat. No. 5,505,889. In this method, fibres comprising a core and a sheath are made by extrusion by fusion. Multiple streams of molten core polymers are conveyed under pressure from a distribution passage into multiple parallel spinneret passages in axial or coaxial alignment with the distributor passages. The sheath polymer in the molten state under pressure is conveyed in channels disposed at the upper surface of the spinneret and surrounding the inlets of the spinneret passages. The polymer forming the sheath is conveyed from ducts into each spinneret passage. Each polymer is conveyed with an adjusted pressure drop. The resulting fibres are treated by conventional means. They are cooled in air and wound, then stretched and curled in a curling box to obtain gathers. Finally the fibres are cut to the desired length, e.g. 38 mm. approx.

When the fibre comprising an elastic core in a non-elastic sheath has been obtained, it is unwound in a cutting system comprising a knife. The fibre is conveyed by unwinding under the knife which, under the control of a synchronised master switch, cuts and breaks a part of the sheath at an angle to the length of the fibre, preferably at regular intervals. The breaks formed in the sheath along the fibre, preferably at regular distances from one another, release the elasticity of the fibre so as to obtain a fibre having suitable elasticity for making elastic nonwovens. The fibre is thus activated to release its elasticity, i.e. the elasticity of the core can be operative as a result of the breaks or cutouts.

According to another embodiment of the invention, starting from the non-activated fibre, i.e. before being torn, broken or cut at intervals along its length, the nonwoven is formed then activated as described for example in U.S. Pat. No. 5,861,074 published on Jan. 19, 1999 where activation consists in conveying the fabric between two cylinders comprising reciprocally offset discs which break the sheath part of the fabric so as to release its elasticity.

The Invention also relates to a nonwoven characterised in that it comprises fibres according to the invention. The nonwoven fabric according to the invention usually contains 20 to 100% by weight, preferably 40 to 100% by weight of fibres according to the invention, the remainder if any being conventional fibres.

In an advantageous embodiment, the nonwoven fabric according to the invention comprises two kinds of fibres according to the invention, one kind for the core and a different kind for the sheath. These differences may relate to the nature of the materials constituting the sheath and/or core and/or the properties thereof. When an easily stretchable nonwoven is required, preference is given to a mixture of two kinds rich in polyethylene, e.g. comprising 5 to 50% or preferably 5 to 25% by weight of polypropylene and 95 to 50% or preferably 75 to 95% of polyethylene. When resistance to stretching is important, 2.5 to 10% by weight of polyethylene and 90 to 97.5% by weight of polypropylene is preferred.

In a highly preferred embodiment, the nonwoven comprises fibres according to the invention having a gathered sheath.

The nonwovens according to the invention are made by conventional processes for producing nonwovens, either mechanical such as calendering under pressure or hydro-interlacing, or via adhesion by chemical means or by thermal bonding. Chemical adhesive bonding involves use of powdered polymer such as pulverulent polyethylene. The powder can be applied between the layers of fibres, then placed in an oven for a short time to melt the powder. Thermal bonding involves melting and softening the surface of the plastic fibres in the nonwoven. This can be done by calendering, bonding in an oven, ultrasonic bonding or radiant heat, Fibres other than those according to the invention can be used, inter alia natural fibres or artificial fibres e.g. cottons, rayon or wool.

The resulting nonwoven is a "zero stress" fabric. If additional stretching forces are applied to the fabric or in a direction as mentioned e.g. in U.S. Pat. No. 5,143,679, 5,242,436 or 5,861,074, the sheath is permanently stretched in the stretching direction. After the stretching force has relaxed, the surface of the sheath gathers and greater thickness or greater length is obtained in the stretching direction, with equal mass per unit volume. This improves the softness and feel of the cloth.

The fabrics according to the invention can weigh 30 to 200 g/m$^2$.

An elastic core fibre and an elastic nonwoven is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A bicomponent elastic fiber, comprising:

(a) a core formed of an elastic fiber; and (b) a sheath formed of a non-elastic material surrounding the core, said sheath formed of a non-elastic material surrounding the core, the sheath having at least one cut therein extending at an angle to the length of the fiber to expose and release the elasticity of the core for providing elasticity to the bicomponent elastic fiber.

2. A bicomponent elastic fiber according to claim 1, wherein said sheath includes a plurality of cuts as predetermined intervals along the length of the core.

3. A fiber according to claim 1, wherein the core stretches by at least 125% of its length in the non-stretched state and loses at least 25% of its length after stretching has stopped.

4. A fiber according to claim 1, and having a denier of 2 to 25.

5. A fiber according to claim 1, wherein the sheath makes up 30% to 70% by weight of the fibre.

6. A fiber according to claim 1, wherein the cuts are distributed in a regular manner.

7. A nonwoven which comprises fibres according to claim 1.

8. A nonwoven according to claim 7, wherein the nonwoven includes fibers other than the bicomponent elastic fibers.

* * * * *